US009152107B2

(12) United States Patent
Kikuchi

(10) Patent No.: US 9,152,107 B2
(45) **Date of Patent: *Oct. 6, 2015**

(54) FIXING DEVICE AND IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kazuhiko Kikuchi, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/227,043

(22) Filed: Mar. 27, 2014

(65) Prior Publication Data

US 2014/0314457 A1 Oct. 23, 2014

(30) Foreign Application Priority Data

Apr. 22, 2013 (JP) ..... 2013-089242

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053
USPC ..... 399/329
See application file for complete search history.

(56) References Cited

U.S. PATENT DOCUMENTS 5,822,669 A * 10/1998 Okabayashi et al. ..... 399/330
7,756,459 B2 7/2010 Ohno
2008/0019742 A1 1/2008 Ohno (Continued)

FOREIGN PATENT DOCUMENTS

JP 2007-226124 9/2007
JP 2011-022446 2/2011

OTHER PUBLICATIONS

Office Action for Japanese Patent Application No. 2013-089242 Dated Dec. 24, 2014, 4 pages.

*Primary Examiner* — Sandra Brase
(74) *Attorney, Agent, or Firm* — Amin, Turocy & Watson, LLP

(57) ABSTRACT

Embodiments in accordance with the current invention encompass a fixing device that includes an endless heat generating section including a conductive layer, a magnetic-flux generating section configured to generate a magnetic flux and generate an induction current in the conduction layer, a first magnetic-flux regulating section having a first magnetic flux concentration force and configured to regulate the magnetic flux of the magnetic flux generating section, a second magnetic-flux regulating section arranged adjacent to the first magnetic-flux regulating section, having a second magnetic flux concentration force larger than the first magnetic flux concentration force, and configured to regulate the magnetic flux of the magnetic-flux generating section, and an auxiliary heat generating section including a magnetic body arranged in a position opposed to the magnetic-flux generating section via the heat generating section, the position being a region extending across the first magnetic-flux regulating section and the second magnetic-flux regulating section.

4 Claims, 7 Drawing Sheets

(56) References Cited

U.S. PATENT DOCUMENTS

2011/0135359 A1* 6/2011 Kikuchi et al. ..... 399/333
2012/0177419 A1 7/2012 Kikuchi
2013/0084112 A1* 4/2013 Sasaki ..... 399/329
2014/0314456 A1* 10/2014 Kikuchi ..... 399/329

* cited by examiner

FIXING DEVICE AND IMAGE FORMING APPARATUS

CROSS-REFERENCE TO RELATED APPLICATION

This application is based upon and claims the benefit of priority from Japanese Patent Application No. 2013-089242, filed Apr. 22, 2013, the entire contents of which are incorporated herein by reference.

FIELD

Embodiments described herein relate generally to a fixing device mounted on a copying machine, a printer, a multi-function peripheral, or the like and an image forming apparatus.

BACKGROUND

As a fixing device used in an image forming apparatus such as a copying machine or a printer, there is a fixing device that generates heat in a conductive layer with an electromagnetic induction heating (IH) system and heats a fixing belt. As the fixing device of the IH system, there is a fixing device reduced in weight by using a magnetic flux regulating member in which a plurality of slit-like ferrite cores are arranged.

In the fixing device including the magnetic flux regulating member in which the plurality of slit-like ferrite cores are arranged, it is likely that heat generation unevenness occurs in boundary regions of the slit-like ferrites adjacent to one another.

The related art is described in, for example, JP-A-2011-22446.

DETAILED DESCRIPTION

It is an object of the present invention to provide a fixing device and an image forming apparatus that can obtain, without spoiling a reduction in the weight of a fixing device of an IH system, equal heat generation in the longitudinal direction of the fixing device and form a satisfactory fixed image.

In general, according to one embodiment, a fixing device includes: an endless heat generating section including a conductive layer; a magnetic-flux generating section configured to generate a magnetic flux and generate an induction current in the conduction layer; a first magnetic-flux regulating section having a first magnetic flux concentration force and configured to regulate the magnetic flux of the magnetic flux generating section; a second magnetic-flux regulating section arranged adjacent to the first magnetic-flux regulating section, having a second magnetic flux concentration force larger than the first magnetic flux concentration force, and configured to regulate the magnetic flux of the magnetic-flux generating section; and an auxiliary heat generating section including a magnetic body arranged in a position opposed to the magnetic-flux generating section via the heat generating section, the position being a region extending across the first magnetic-flux regulating section and the second magnetic-flux regulating section.

Embodiments are explained below.

First Embodiment

Figure 1:
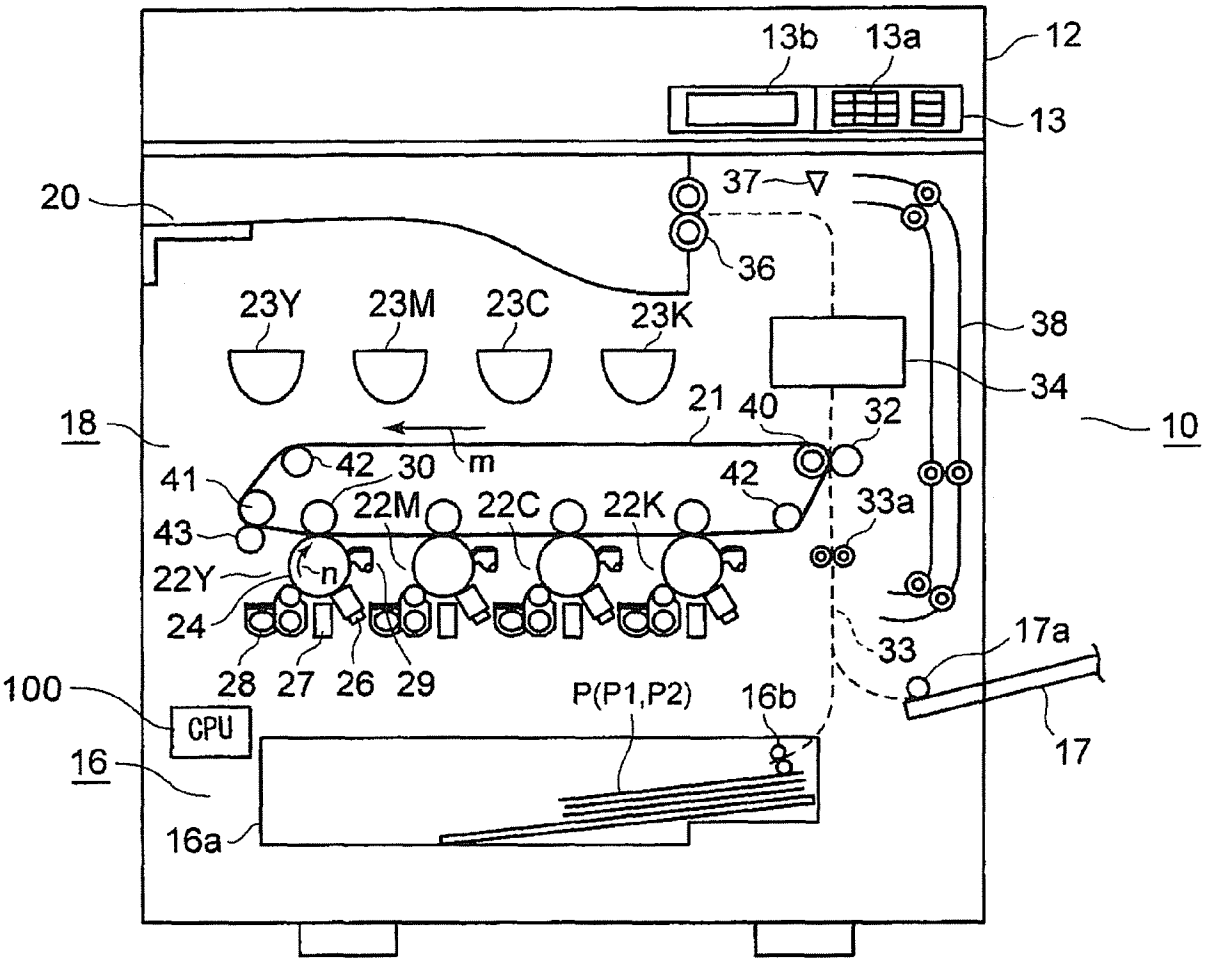
FIG. 1 is a schematic configuration diagram showing an MFP mounted with a fixing device in a first embodiment.

A fixing device in a first embodiment is explained with reference to FIGS. 1 to 7. FIG. 1 shows an MFP (Multi-Function Peripheral) 10, which is an example of an image forming apparatus in this embodiment. The MFP 10 includes, for example, a scanner 12, a control panel 13, a paper feeding cassette section 16, a paper feeding tray 17, a printer section 18, and a paper discharge section 20. The MFP 10 includes a CUP 100 configured to control a main body control circuit 101 and control the entire MFP 10.

The scanner 12 reads a document image for forming an image in the printer section 18. The control panel 13 includes, for example, an input key 13*a* and a display section 13*b* of a touch panel type. The input key 13*a* receives, for example, an input by a user. The display section 13*b* receives, for example, an input by the user or performs display for the user.

The paper feeding cassette section 16 includes a paper feeding cassette 16*a* configured to store sheets P, which are recording media, and a pickup roller 16*b* configured to pick up the sheets P from the paper feeding cassette 16*a*. The paper feeding cassette 16*a* is capable of feeding unused sheets P1 or reuse sheets (e.g., sheets on which images are decolored by decoloration treatment). The paper feeding tray 17 is capable of feeding the unused sheets P1 or the reuse sheets P2 with a pickup roller 17*a*.

The printer section 18 includes an intermediate transfer belt 21. The printer section 18 supports the intermediate transfer belt 21 with a backup roller 40 including a driving section, a driven roller 41, and a tension roller 42 and rotates in an arrow m direction.

The printer section 18 includes four sets of image forming stations 22Y, 22M, 22C, and 22K of Y (yellow), M (magenta), C (cyan), and K (black) arranged in parallel along the lower side of the intermediate transfer belt 21. The printer section 18 includes supply cartridges 23Y, 23M, 23C, and 23K above the image forming stations 22Y, 22M, 22C, and 22K.

The supply cartridges 23Y, 23M, 23C, and 23K respectively store toners for supply of Y (yellow), M (magenta), C (cyan), and K (black).

For example, the image forming station 22Y of Y (yellow) includes an electrifying charger 26, an exposing and scanning head 27, a developing device 28, and a photoconductive cleaner 29 around a photoconductive drum 24 that rotates in an arrow n direction. The image forming station 22Y of Y (yellow) includes a primary transfer roller 30 in a position opposed to the photoconductive drum 24 via the intermediate transfer belt 21.

The three sets of image forming stations 22M, 22C, and 22K of M (magenta), C (cyan), and K (black) include components same as the components of the image forming station 22Y of Y (yellow). Detailed explanation concerning the components of the three sets of image forming stations 22M, 22C, and 22K of M (magenta), C (cyan), and K (black) is omitted.

In the image forming stations 22Y, 22M, 22C, and 22K, after the photoconductive drums 24 are charged by the electrifying chargers 26, the photoconductive drums 24 are exposed by the exposing and scanning heads 27 to respectively form electrostatic latent images on the photoconductive drums 24. The developing devices 28 respectively develop the electrostatic latent images on the photoconductive drums 24 using two-component developers including toners of Y (yellow), M (magenta), C (cyan), and K (black) and a carrier. As the toners used for the development, for example, non-decolorable toners or decolorable toners are used.

The decolorable toner is a toner decolorable by being heated to temperature equal to or higher than, for example, a predetermined decoloring temperature. The decolorable toner is formed by, for example, mixing a color material in binder resin. A color material includes at least a coloring compound, a developing agent, and a decoloring agent. The color material can be combined with a discoloring temperature adjusting agent or the like according to necessity such that color development disappears at temperature equal to or higher than a certain fixed temperature. If a toner image formed using the decolorable toner is heated to temperature equal to or higher than the decoloring temperature, the coloring compound and the developing agent in the decolorable toner are dissociated to decolor the toner image.

As the coloring compound included in the color material, a leuco dye such as dephenylmethane phthalides is used as a generally well-known coloring compound. The leuco dye is an electron-donating compound capable of developing a color with the developing agent.

The developing agent included in the color material is an electron-accepting compound that gives a proton to the leuco dye such as phenols and phenolic metal salts.

As the decoloring agent included in the color material, a publicly-known decoloring agent can be used as long as the decoloring agent can hinder a color development reaction by the coloring compound and the developing agent with heat in a three-component system of the coloring compound, the developing agent, and the decoloring agent and erase a color. For example, an erasing agent that makes use of a temperature hysteresis such as alcohols or esters is excellent in an instantaneous erasing property in a color developing and decoloring mechanism. In the color developing and decoloring mechanism that makes use of the temperature hysteresis, the decolorable toner that develops a color can be heated to temperature equal to or higher than a specific decoloring temperature and decolored. For example, the decolorable toner can be fixed on a sheet at a relatively low temperature and decolored at temperature higher than the fixing temperature by, for example, about 10° C.

A type of the binder resin is not particularly limited as long as the binder resin is resin having a low melting point or a low glass transition point temperature Tg that can be fixed at temperature lower than the decoloring temperature of the color material mixed in the binder resin. As the binder resin, there are, for example, polyester resin and polystyrene resin. These kinds of binder resin can be selected as appropriate according to the color material mixed therein.

The primary transfer rollers 30 primarily transfer toner images formed on the photoconductive drums 24 onto the intermediate transfer belt 21. The image forming stations 22Y, 22M, 22C, and 22K sequentially superimpose, with the primary transfer rollers 30, toner images of Y (yellow), M (magenta), C (cyan), and K (black) on the intermediate transfer belt 21 and form a color toner image. The photoconductive cleaners 29 remove the toners remaining on the photoconductive drums 24 after the primary transfer.

The printer section 18 includes a secondary transfer roller 32 in a position opposed to the backup roller 40 via the intermediate transfer belt 21. The secondary transfer roller 32 collectively secondarily transfers the color toner image on the intermediate transfer belt 21 onto the sheet P. The sheet P is fed from the paper feeding cassette section 16 or the manual paper feeding tray 17 along a conveying path 33 in synchronization with the transfer of the color toner image on the intermediate transfer belt 21. The belt cleaner 43 removes the toners remaining on the intermediate transfer belt 21 after the secondary transfer. The intermediate transfer belt 21, the four sets of image forming stations 22Y, 22M, 22C, and 22K, and the secondary transfer roller 32 configure an image forming section.

The printer section 18 includes a registration roller 33*a*, a fixing device 34, and a paper discharge roller 36 along the conveying path 33. The printer section 18 includes a diverting section 37 and a reverse conveying section 38 downstream of the fixing device 34. The diverting section 37 diverts the sheet P after fixing to the paper discharge section 20 or the reverse conveying section 38. In duplex printing, the reverse conveying section 38 reverses and conveys the sheet P, which is diverted by the diverting section 37, in the direction of the registration roller 33*a*.

With these components, the MFP 10 forms a fixed toner image on the sheet P in the printer section 18 and discharges the sheet P to the paper discharge section 20.

The image forming apparatus is not limited to a tandem system. The number of developing devices is not limited. The image forming apparatus may transfer a toner image directly from a photoconductive body to a recording medium.

Figure 2:
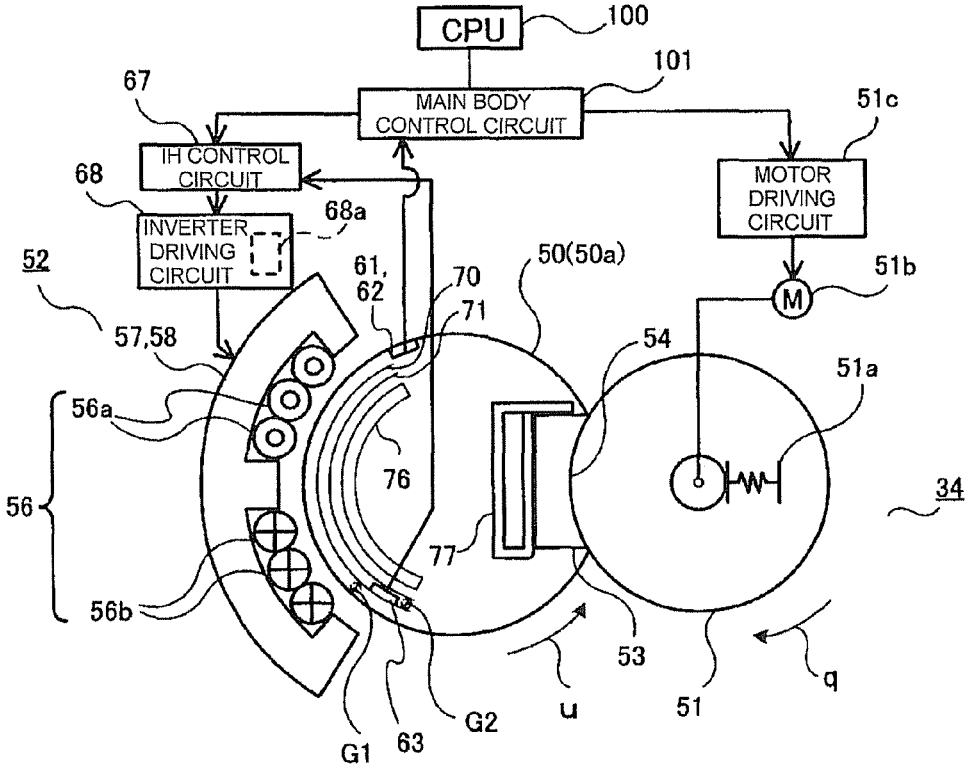
FIG. 2 is a schematic configuration diagram showing a fixing device including a control block of an IH coil unit in the first embodiment.

The fixing device 34 is explained in detail. As shown in FIG. 2, the fixing device 34 includes a fixing belt 50, which is a heat generating section, a press roller 51, and an electromagnetic induction heating coil unit (hereinafter generally referred to as IH coil unit) 52, which is an induction-current generating unit. The fixing belt 50 includes, on the inside, a nip pad 53, a magnetic shunt alloy layer 70, which is a temperature-sensitive magnetic body, a magnetic plate 71, and a shield 76. The fixing belt 50 includes, on the inside, a center thermistor 61, an edge thermistor 62, a thermostat 63, and a stay 77 configured to support the nip pad 53.

The fixing belt 50 rotates in an arrow u direction following or independently from the press roller 51. The fixing belt 50 has a multilayer structure including a heat generating layer 50*a*, which is a conductive layer. In the fixing belt 50, for example, the heat generating layer 50*a*, an elastic layer, and a release layer are laminated in this order from the inner circumferential side to the outer circumferential side. A layer structure of the fixing belt 50 is not limited as long as the fixing belt 50 includes the heat generating layer 50*a*. In order to enable quick warming-up of the fixing belt 50, the heat generating layer 50*a* is reduced in thickness to reduce a heat capacity. The fixing belt 50 including the heat generating layer 50*a* having the reduced heat capacity reduces time necessary for the warming-up and saves energy consumption.

The heat generating layer 50*a* of the fixing belt 50 is formed of, for example, nickel (Ni), iron (Fe), stainless steel, aluminum (Al), copper (Cu), or silver (Ag). The heat generating layer 50*a* may include two or more kinds of alloys or may be configured by superimposing two or more kinds of metal in a layer form. The heat generating layer 50*a* generates an eddy-current with a magnetic flux generated by the IH coil unit 52. The heat generating layer 50*a* generates Joule heat with the eddy-current and a resistance value of the heat generating layer 50*a* and heats the fixing belt 50. The elastic layer of the fixing belt 50 is made of an elastic body such as silicone rubber. The release layer of the fixing belt 50 is formed of, for example, fluorocarbon resin. The shape of the fixing belt 50 is not limited.

The center thermistor 61 and the edge thermistor 62 detect the temperature of the fixing belt 50. The temperature of the fixing belt 50 may be detected using a non-contact sensor. The thermostat 63 detects abnormal heat generation of the fixing device 34.

The nip pad 53 presses the inner circumferential surface of the fixing belt 50 to the press roller 51 side and forms a nip 54 between the fixing belt 50 and the press roller 51. The nip pad 53 is formed of, for example, heat-resistant polyphenylene sulfide resin (PPS), liquid crystal polymer (LOP), phenolic resin (PF), or the like. For example, a sheet having high slidability and abrasion resistance is interposed, for example, between the heat-resistant fixing belt 50 and the nip pad 53. Alternatively, the nip pad 53 includes a release layer formed of fluorocarbon resin. Frictional resistance between the fixing belt 50 and the nip pad 53 is reduced by the sheet or the release layer.

The press roller 51 includes a heat-resistant silicon sponge, silicone rubber layer, or the like around, for example, a core bar and includes a release layer formed of fluorocarbon resin such as PFA on the surface. The press roller 51 is pressed against the nip pad 53 by a pressing mechanism 51*a*. The press roller 51 rotates in an arrow q direction with a motor 51*b* driven by a motor driving circuit 51*c* controlled by the main body control circuit 101.

Figure 3:
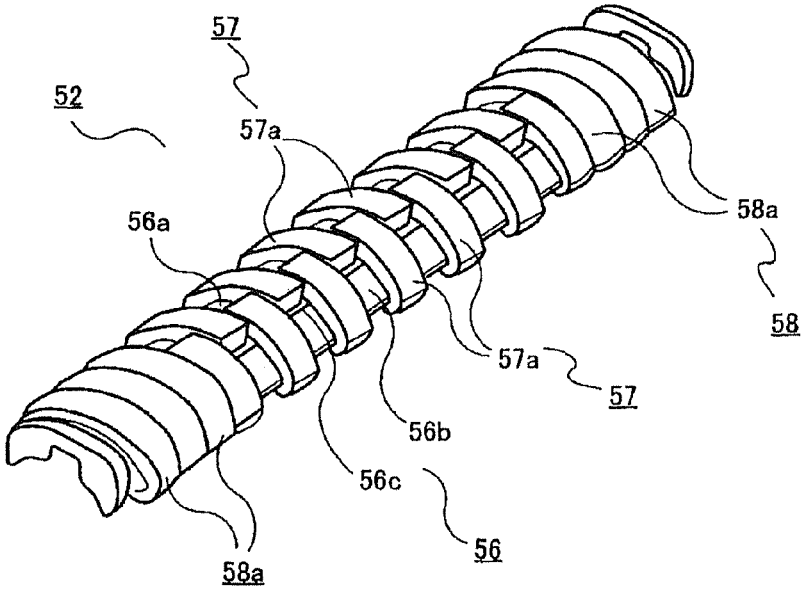
FIG. 3 is a schematic perspective view showing the IH coil unit.
Figure 4:
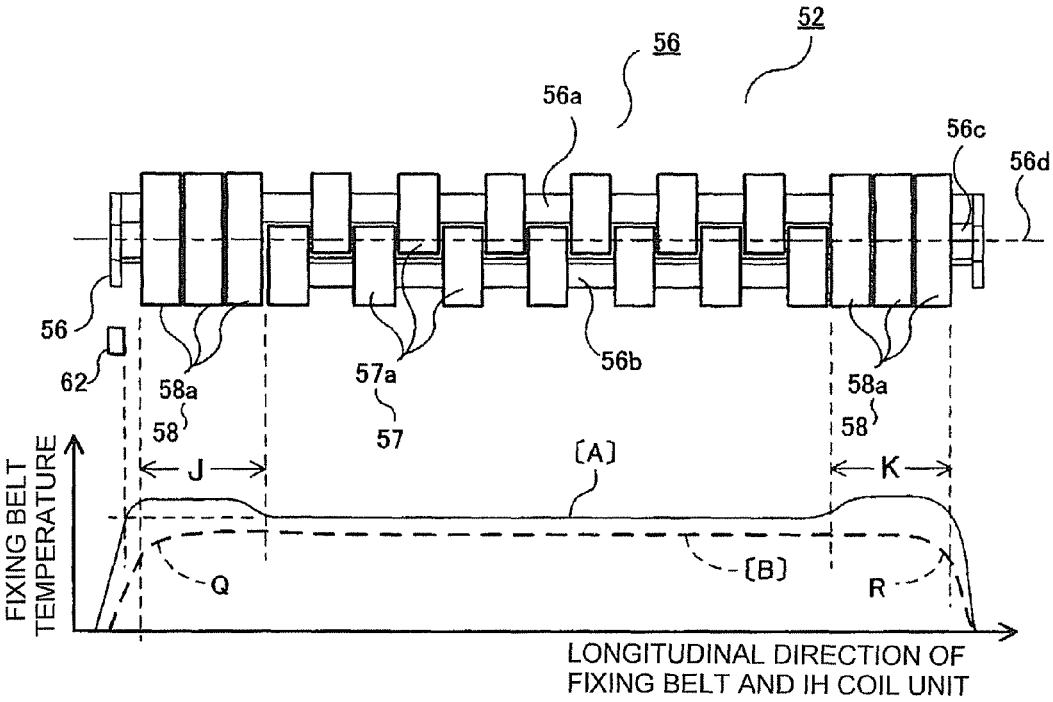
FIG. 4 is a schematic explanatory diagram showing a relation between the IH coil unit and the temperature of a fixing belt in the first embodiment.

As shown in FIGS. 3 and 4, the IH coil unit 52 includes a coil 56, which is a magnetic-flux generating unit. The IH coil unit 52 is present on the outer circumference of the fixing belt 50. The coil 56 is opposed to the fixing belt 50. The IH coil unit 52 includes a first core 57, which is a first magnetic-flux regulating section configured to regulate a magnetic flux, which is generated by the coil 56, alternately for each of one-wings. The first core 57 concentrates the magnetic flux, which is generated by the coil 56, in the direction of the fixing belt 50 with a first magnetic flux concentration force. The IH coil unit 52 includes second cores 58, which are second magnetic-flux generating units configured to regulate a magnetic flux of both-wings generated by the coil 56, on both sides of the first core 57.

The second cores 58 concentrate the magnetic flux, which is generated by the coil 56, in the direction of the fixing belt 50 with a second magnetic flux concentration force. The second magnetic flux concentration force is larger than the first magnetic flux concentration force. While the fixing belt 50 rotates in the arrow u direction, the IH coil unit 52 generates an induction current in the heat generating layer 50*a* of the fixing belt 50 opposed to the IH coil unit 52.

As the coil 56, for example, a litz wire obtained by binding a plurality of copper wire rods coated with heat-resistant polyamideimide, which is an insulating material, is used. The coil 56 is formed by winding a conductive coil. Window sections 56*c* are formed in the centers of left and right wings 56*a* and 56*b*. The center of the window section 56*c* is a center line 56*d* in the longitudinal direction of the coil 56.

The coil 56 generates a magnetic flux according to application of a high-frequency current from an inverter driving circuit 68. The inverter driving circuit 68 includes, for example, an IGBT (Insulted Gate Bipolar Transistor) element 68*a*. An IH control circuit 67 controls, via the main body control circuit 101, according to detection results of the center thermistor 61 and the edge thermistor 62, the magnitude of the high-frequency current output by the inverter driving circuit 68.

Figure 5:
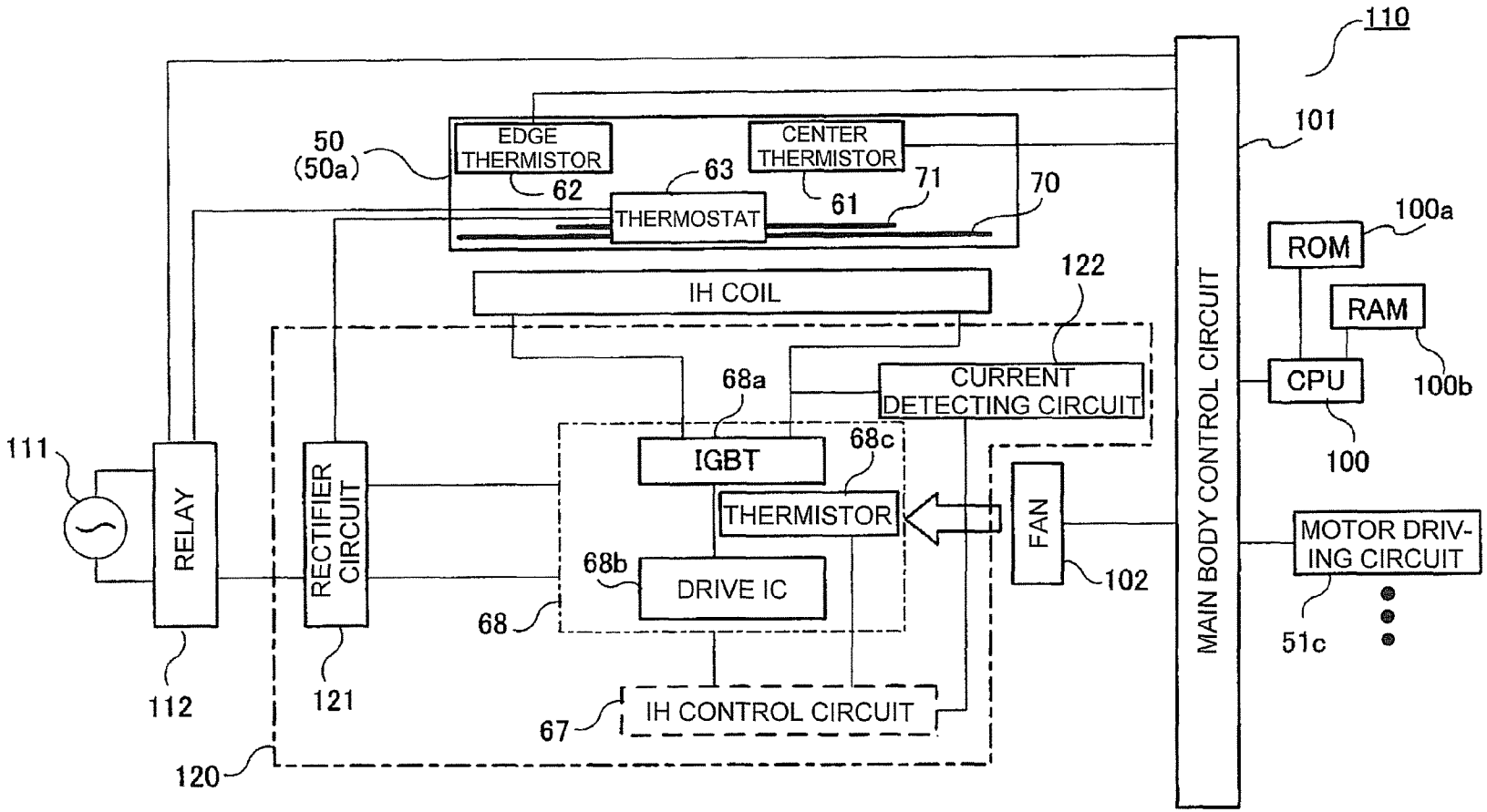
FIG. 5 is a schematic block diagram showing a control system mainly for control of the IH coil unit.

A control system 110 configured to mainly control the IH coil unit 52 that causes the fixing belt 50 to generate heat is explained with reference to FIG. 5. The control system 110 includes, for example, a CPU 100 configured to control the entire MFP 10, a read only memory (ROM) 100*a*, a random access memory (RAM) 100*b*, a main body control circuit 101, and an IH circuit 120. The control system 110 supplies, with the IH circuit 120, electric power to the IH coil unit 52. The IH circuit 120 includes a rectifier circuit 121, the IH control circuit 67, the inverter driving circuit 68, and a current detecting circuit 122.

The IH circuit 120 rectifies, with the rectifier circuit 121, an electric current input from a commercial alternating-current power supply 111 via a relay 112 and supplies the electric current to the inverter driving circuit 68. If the thermostat 63 is cut, the relay 112 cuts off the electric current input from the commercial alternating-current power supply 111. The inverter driving circuit 68 includes a drive IC 68*b* for the IGBT 68*a* and a thermistor 68*c*. The thermistor 68*c* detects the temperature of the IGBT 68*a*. If the thermistor 68*c* detects a temperature rise of the IGBT 68*a*, the main body control circuit 101 drives a fan 102 and attains cooling of the IGBT 68*a*.

The IH control circuit 67 controls the drive IC 68*b* according to the detection results of the center thermistor 61 and the edge thermistor 62 and controls an output of the IGBT 68*a*. The current detecting circuit 122 detects the output of the IGBT 68*a* and feeds back the output to the IH control circuit 67. The IH control circuit 67 feedback-controls the drive IC 68*b* according to a detection result of the current detecting circuit 122 such that supply power to the coil 56 is fixed.

The first core 57 and the second cores 58 cover the rear surface of the coil 56 opposed to the fixing belt 50 and concentrate the magnetic flux, which is generated by the coil 56, in the direction of the fixing belt 50. The first core 57 and the second cores 58 prevent the magnetic flux, which is generated by the coil 56, from leaking in the rear surface direction and improve efficiency of the concentration of the magnetic flux, which is generated by the coil 56, in the direction of the fixing belt 50.

In the first core 57, a plurality of one-wing slits 57*a* made of a magnetic body are alternately arranged in zigzag axially symmetrically with respect to a center line 56*d* in the longitudinal direction of the coil 56 to cover the rear surface of the coil 56 for each of the one-wings. In the second cores 58, for example, three both-wing slits 58*a* made of a magnetic body extending across both-wings of the coil 56 are arranged adjacent to one another to cover both-wings on the rear surface of the coil 56. The one-wing slits 57*a* and the both-wing slits 58*a* are, for example, formed of a magnetic material such as a nickel zinc alloy (Ni—Zn) or a manganese nickel alloy (Mn—Ni).

A temperature measurement result in the longitudinal direction obtained when the fixing belt 50 is heated by the IH coil unit 52 is indicated by a solid line A in FIG. 4. In the fixing belt 50, a temperature rise was obtained in regions J and K opposed to the second cores 58 on both sides of the IH coil unit 52. The fixing device 34 can obtain satisfactory fixing over the entire length in the longitudinal direction of the fixing belt 50 without causing a fixing failure at end portions of the sheet P.

As a comparative example 1, as a result of measuring the temperature in the longitudinal direction of the fixing belt 50 when the entire length of an IH coil unit was formed of only a core of one-wing, a broken line B in FIG. 4 was obtained. In the comparative example 1, the fixing belt 50 causes a drop of temperature in positions Q and R corresponding to both sides of the IH coil unit. It is likely that the fixing device in the comparative example 1 causes a fixing failure at the end portions of the sheet P because of the drop of the temperature in the positions Q and R. In the first embodiment, by providing the second cores 58 of the both-wings, a fixing failure due to a drop of the temperature of the fixing belt 50 is prevented from occurring in regions corresponding to end portions of the IH coil unit 52.

The magnetic shunt alloy layer 70 is formed in an arcuate shape along the inner circumferential surface of the fixing belt 50 with a gap G1 apart from the inner circumferential surface of the fixing belt 50. The magnetic shunt alloy layer 70 is configured by a magnetic shunt alloy member, a magnetic characteristic of which changes according to temperature. The magnetic shunt alloy layer 70 changes from a ferromagnetic body to a paramagnetic (nonmagnetic) body at the Curie temperature Tc.

Figure 6:
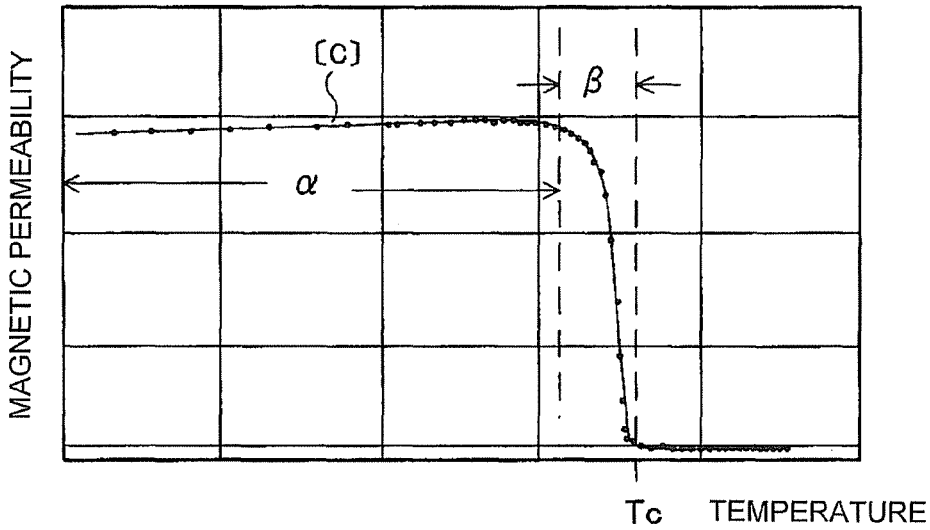
FIG. 6 is a graph for explaining a magnetic characteristic of a magnetic shunt alloy used in a magnetic shunt alloy layer in the first embodiment.

As indicated by a solid line C in FIG. 6, the magnetic characteristic of the magnetic shunt alloy member suddenly changes near the Curie temperature Tc. The Curie temperature Tc of the magnetic shunt alloy member is different depending on the member. The magnetic shunt alloy member shows a characteristic of the ferromagnetic body having high magnetic permeability in a low-temperature region α. The magnetic permeability increases as temperature rises. In the magnetic shunt alloy member, the magnetic permeability suddenly decreases in proportion to the rise of the temperature in a transition region β close to the Curie temperature Tc. If the temperature reaches the Curie temperature Tc, the magnetic shunt alloy member shows a characteristic of the paramagnetic body having substantially zero magnetic permeability and does not generate an induction current.

The magnetic shunt alloy layer 70 is configured by, for example, an iron nickel magnetic shunt alloy member having the Curie temperature Tc of 200° C. In the low-temperature region a where the temperature of the magnetic shunt alloy layer 70 is lower than the Curie temperature Tc, the magnetic shunt alloy layer 70 shows the characteristic of the ferromagnetic body. The magnetic shunt alloy layer 70 generates heat with an induction current by a magnetic flux generated by the IH coil unit 52. The magnetic shunt alloy layer 70 in the low-temperature region a assists heating of the fixing belt 50 in conjunction with heat generation by the heat generating layer 50*a* of the fixing belt 50 by the IH coil unit 52. The material of the magnetic shunt alloy layer, the Curie temperature, and the like are not limited.

During the warming-up, the magnetic shunt alloy layer 70 generates heat with the magnetic flux generated by the IH coil unit 52 and assists the heating of the fixing belt 50 in conjunction with the heating by the heat generating layer 50*a* of the fixing belt 50. The magnetic shunt alloy layer 70 accelerates the warming-up of the fixing belt 50. During printing, if the temperature does not reach the Curie temperature Tc, the magnetic shunt alloy layer 70 assists the heating of the fixing belt 50 in conjunction with the heating by the heat generating layer 50*a* of the fixing belt 50 and maintains a fixing temperature.

If the temperature of the magnetic shunt alloy layer 70 reaches the transition region β, the magnetic flux flowing through the magnetic shunt alloy layer 70 suddenly decreases. In the transition region β, the heat value of the magnetic shunt alloy layer 70 decreases. If the temperature of the magnetic shunt alloy layer 70 reaches the Curie temperature Tc, the magnetic shunt alloy layer 70 shows the characteristic of the paramagnetic body having the substantially zero magnetic permeability and stops the heat generation. During continuous paper feeding, for example, if the temperature of the fixing belt 50 rises and the magnetic shunt alloy layer 70 reaches the Curie point in a non-paper passing region, the magnetic shunt alloy layer 70 does not generate an induction current and prevents an excessive temperature rise of the fixing belt 50.

The magnetic shunt alloy layer 70 has reversibility. If the temperature of the magnetic shunt alloy layer 70 falls below the Curie temperature Tc, the magnetic shunt alloy layer 70 is restored to the ferromagnetic body from the paramagnetic body.

The magnetic plate 71 is formed in an arcuate shape along the inner circumferential surface of the magnetic shunt alloy layer 70 with a gap G2 apart from the inner circumferential surface of the magnetic shunt alloy layer 70. The magnetic plate 71 is, for example, configured by a member having a magnetic characteristic such as iron (Fe) or nickel (Ni). The magnetic plate 71 shows a fixed magnetic characteristic irrespective of the temperature of the magnetic plate 71.

The magnetic plate 71 generates an eddy-current with a magnetic flux generated by the IH coil unit 52 and generates heat. The magnetic plate 71 assists the heating of the fixing belt 50 in conjunction with the heat generation by the heat generating layer 50*a* of the fixing belt 50 and the heat generation of the magnetic shunt alloy layer 70 by the IH coil unit 52. The gap G2 between the magnetic plate 71 and the magnetic shunt alloy layer 70 prevents the heat generation of the magnetic plate 71 from being directly conducted to the magnetic shunt alloy layer 70. The gap G2 delays the heat conduction from the magnetic plate 71 to the magnetic shunt alloy layer 70 and delays the magnetic shunt alloy layer 70 reaching the Curie temperature Tc.

Figure 7:
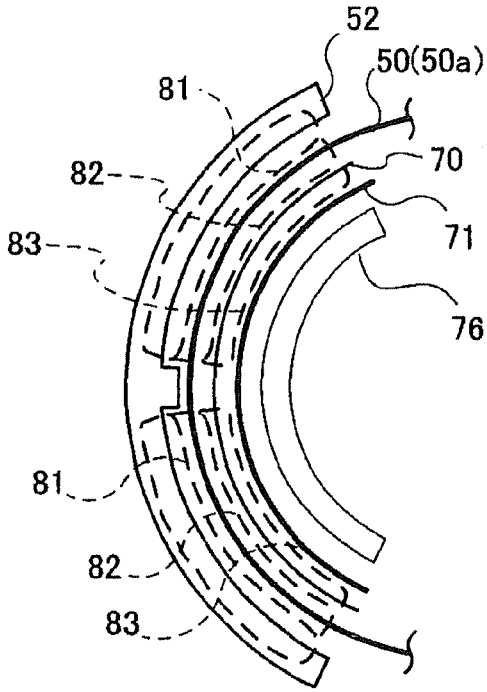
FIG. 7 is a schematic explanatory diagram showing a magnetic path to the fixing belt, the magnetic shunt alloy layer, and the magnetic plate by a magnetic flux of the IH coil unit.

As shown in FIG. 7, the magnetic flux generated by the IH coil unit 52 forms a first magnetic path 81 induced by the heat generating layer 50*a* of the fixing belt 50. Further, the magnetic flux generated by the IH coil unit 52 forms a second magnetic path 82 induced by the magnetic shunt alloy layer 70 and a third magnetic path 83 induced by the magnetic plate 71.

During the warming-up of the fixing belt 50, the magnetic plate 71 assists the heat generation by the heat generating layer 50*a* of the fixing belt 50 in conjunction with the magnetic shunt alloy layer 70 and accelerates the warming-up. During printing, the magnetic plate 71 assists the heat generation by the heat generating layer 50*a* of the fixing belt 50 in conjunction with the magnetic shunt alloy layer 70 and maintains a fixing temperature. Even after the temperature of the magnetic shunt alloy layer 70 reaches the Curie temperature Tc, the magnetic plate 71 generates heat with the magnetic flux generated by the IH coil unit 52 and assists the heat generation of the fixing belt 50.

Figure 8:
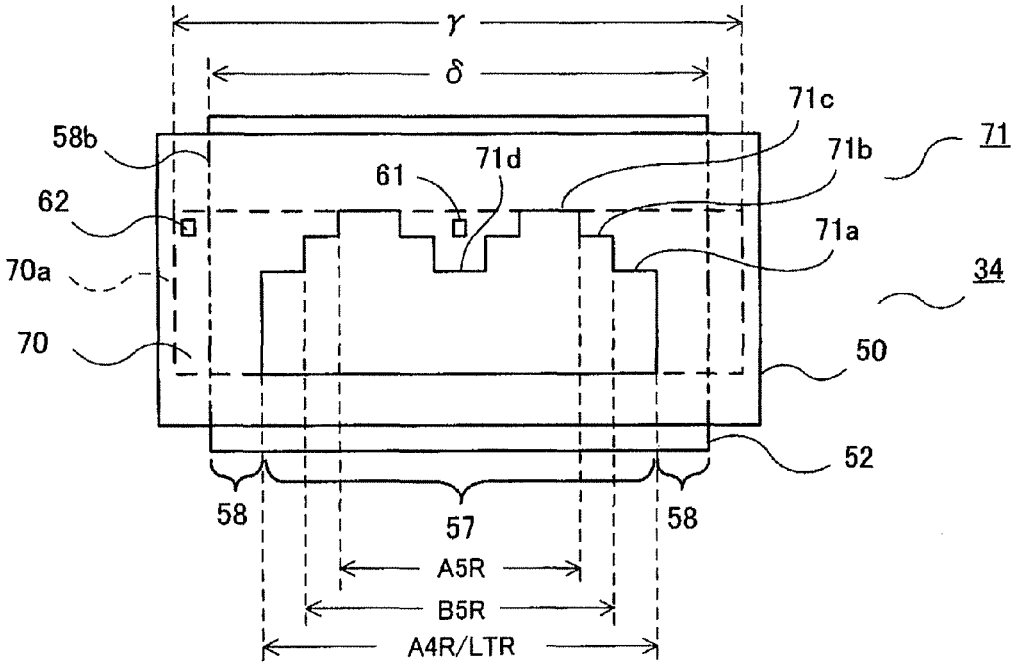
FIG. 8 is a schematic explanatory diagram showing the arrangement of the magnetic plate, the magnetic shunt alloy layer, the fixing belt, and the IH coil unit viewed from the magnetic plate side in the first embodiment.

As shown in FIG. 8, the magnetic plate 71 includes a plurality of widths stepwise. For example, a first stage 71*a* of the magnetic plate 71 is formed in width for covering the A4R size and the letter size of the JIS standard. A second stage 71*b* of the magnetic plate 71 is formed in width for covering the B5R size of the JIS standard. A third stage 71*c* of the magnetic plate 71 is formed in width for covering the A5R size of the JIS standard.

The magnetic plate 71 is formed stepwise to adjust a heat value of the magnetic plate 71 in the longitudinal direction of the fixing belt 50. If the sheets P having a small size are continuously subjected to fixing, the heat value of the magnetic plate 71 in the non-paper passing region is reduced to prevent the fixing belt 50 from excessively generating heat in the non-paper passing region. The shape of the magnetic plate 71 is not limited. The magnetic plate 71 does not have to have the plurality of widths stepwise as long as the magnetic plate 71 can prevent excessive heat generation in the non-paper passing region.

A cutout section 71*d* is formed in the center region of the magnetic plate 71 in a position corresponding to the center thermistor 61. The cutout section 71*d* prevents the heat generation of the magnetic plate 71 from affecting a detection result of the center thermistor 61. Since the cutout section 71*d* is formed, the center thermistor 61 detects the temperature of the center region of the fixing belt 50 at high accuracy.

As shown in FIG. 8, the width of the first stage 71*a* of the magnetic plate 71 is substantially equal to an arrangement region of the first core 57 of the IH coil unit 52. Width γ of the magnetic shunt alloy layer 70 is larger than width δ of the IH coil unit 52. The edge thermistor 62 is arranged in a position corresponding to a position between an end portion 58*b* of the second core 58 and an end portion 70*a* of the magnetic shunt alloy layer 70 in the longitudinal direction of the fixing belt 50. The edge thermistor 62 is arranged further on the outer side than the end portion 58*b* of the second core 58 to detect the temperature of the fixing belt 50 avoiding a temperature rise region by the second core 58. The edge thermistor 62 detects the temperature at the end portion of the fixing belt 50 without being affected by the second core 58. The edge thermistor 62 detects the temperature of an edge region of the fixing belt 50 at high accuracy.

The shield 76 is configured by a nonmagnetic member such as aluminum (Al) or copper (Cu). The shield 76 blocks the magnetic flux generated by the IH coil unit 52 and prevents the magnetic flux from affecting the stay 77, the nip pad 53, and the like inside the fixing belt 50.

The action of the fixing device 34 is explained.

During the Warming-up

During the warming-up, the fixing device 34 rotates the press roller 51 in the arrow q direction and rotates the fixing belt 50 in the arrow u direction to follow the press roller 51. According to application of a high-frequency current by the inverter driving circuit 68, the IH coil unit 52 generates a magnetic flux in the direction of the fixing belt 50.

The magnetic flux of the IH coil unit 52 is induced by the first magnetic path 81, which passes through the heat generating layer 50*a* of the fixing belt 50, to cause the heat generating layer 50*a* to generate heat. The magnetic flux of the IH coil unit 52 transmitted through the fixing belt 50 is induced by the second magnetic path 82, which passes through the magnetic shunt alloy layer 70, and causes the magnetic shunt alloy layer 70 to generate heat. Further, the magnetic flux of the IH coil unit 52 transmitted through the magnetic shunt alloy layer 70 is induced by the third magnetic path 38, which passes through the magnetic plate 71, and causes the magnetic plate 71 to generate heat.

The heat generation of the magnetic shunt alloy layer 70 is conducted to the fixing belt 50 via the gap G1. The heat generation of the magnetic plate 71 is conducted to the fixing belt 50 via the gap G2 and the gap G1. The heat conduction from the magnetic shunt alloy layer 70 and the magnetic plate 71 to the fixing belt 50 promotes quick warming-up of the fixing belt 50. The IH control circuit 67 feedback-controls the inverter driving circuit 68 according to a detection result of the center thermistor 61 or the edge thermistor 62. The inverter driving circuit 68 supplies a required electric current to the coil 56.

During Fixing Operation

If the fixing belt 50 reaches the fixing temperature and ends the warming-up, the MFP 10 starts printing operation. The MFP 10 forms a toner image on the sheet Pin the printer section 18 and conveys the sheet P in the direction of the fixing device 34.

The MFP 10 causes the sheet P, on which the toner image is formed, to pass through the nip 54 between the fixing belt 50, which reaches the fixing temperature, and the press roller 51 and fixes the toner image on the sheet P. While the fixing is performed, the IH control circuit 67 feedback-controls the IH coil unit 52 and keeps the fixing belt 50 at the fixing temperature.

The heat of the fixing belt 50 is deprived by the sheet P according to the fixing operation. For example, if the fixing operation is continuously performed at high speed, a heat quantity deprived by the sheet P is large. It is likely that the fixing belt 50 having a low heat capacity cannot keep the fixing temperature. The heat conduction from the magnetic shunt alloy layer 70 and the magnetic plate 71 to the fixing belt 50 heats the fixing belt 50 from the inner circumference of the fixing belt 50 and compensates for a shortage of the heat value of the fixing belt 50. The fixing belt 50 is heated by the heat conduction from the magnetic shunt alloy layer 70 and the magnetic plate 71 to the fixing belt 50 to keep the temperature of the fixing belt 50 at the fixing temperature even during the continuous fixing operation at high speed. If the magnetic shunt alloy layer 70 reaches the Curie temperature For example, if the fixing operation is continuously performed at high speed, if it is attempted to keep the fixing belt 50 at the fixing temperature, the temperature of the magnetic shunt alloy layer 70 gradually rises. If the temperature of the magnetic shunt alloy layer 70 reaches the transition region β close to the Curie temperature Tc, the magnetic permeability of the magnetic shunt alloy layer 70 suddenly decreases. Further, if the temperature of the magnetic shunt alloy layer 70 reaches the Curie temperature Tc, the magnetic permeability decreases to substantially zero and the heat value decreases to zero.

If the magnetic shunt alloy layer 70 reaches the Curie temperature Tc, the heat conduction from the magnetic shunt alloy layer 70 to the fixing belt 50 decreases to zero. If the magnetic shunt alloy layer 70 reaches the Curie temperature Tc, the magnetic flux of the IH coil unit 52 transmitted through the fixing belt 50 is transmitted through the magnetic shunt alloy layer 70 and induced by the magnetic plate 71.

If the magnetic shunt alloy layer 70 reaches the Curie temperature Tc, the heat generation of the magnetic plate 71 by the magnetic flux of the IH coil unit 52 is conducted to the fixing belt 50 via the gap G2 and the gap G1. If the magnetic shunt alloy layer 70 reaches the Curie temperature Tc and the heat generation of the magnetic shunt alloy layer 70 decreases to zero, the heating of the fixing belt 50 is assisted by the heat generation of the magnetic plate 71. If the magnetic shunt alloy layer 70 reaches the Curie temperature Tc during the continuous fixing operation at high speed, the temperature of the fixing belt 50 is kept at the fixing temperature by the heat generation of the magnetic plate 71.

Even if the magnetic shunt alloy layer 70 reaches the Curie temperature Tc and does not generate heat, the center thermistor 61 or the edge thermistor 62 detects that the fixing belt 50 keeps the fixing temperature. Even if the magnetic shunt alloy layer 70 does not generate heat, the IH control circuit 67 controls the inverter driving circuit 68 in substantially the same manner as controlling the inverter driving circuit 68 when the magnetic shunt alloy layer 70 generates heat. Even if the magnetic shunt alloy layer 70 does not generate heat, the inverter driving circuit 68 does not need to increase and continue to supply the high-frequency current in order to raise the temperature of the fixing belt 50. Even if the magnetic shunt alloy layer 70 does not generate heat, the temperature of the fixing belt 50 is kept at the fixing temperature by the heat generation of the magnetic plate 71 to prevent a load applied to the IGBT element 68*a* and the like of the inverter driving circuit 68 from increasing.

After the magnetic shunt alloy layer 70 reaches the Curie temperature Tc, if the fixing belt 50 abnormally generates heat, the thermostat 63 is cut. If the thermostat 63 is cut, the relay 112 cuts off the electric current fed from the commercial alternating-current power supply 111 to the rectifier circuit 121. The CPU 100 cuts off the power supply from the IH control circuit 67 to the IH coil unit 52 and stops excessive heat generation of the fixing device 34.

According to the first embodiment, the magnetic plate is arranged with the gap G2 apart from the inner circumference of the magnetic shunt alloy layer 70. During the continuous fixing at high speed or the like, even if the magnetic shunt alloy layer 70 reaches the Curie temperature Tc and stops the heat generation, the magnetic plate 71 generates heat and assists the heating of the fixing belt 50. If the magnetic shunt alloy layer 70 stops the heat generation, the inverter driving circuit 68 does not need to increase the high-frequency current or continue to feed the high-frequency current in an attempt to increase the heat value of the heat generating layer 50*a*. If the magnetic shunt alloy layer 70 stops the heat generation, an excessively large load is prevented from being applied to the IGBT element 68*a* and the like. If the magnetic shunt alloy layer 70 stoops the heat generation, the inverter driving circuit 68 is prevented from being heated and broken by an excessively large load and satisfactory fixing performance is obtained.

The heat generation of the magnetic plate 71 is prevented from be directly conducted to the magnetic shunt alloy layer 70 by the gap G2. The heating of the magnetic shunt alloy layer 70 by the heat generation of the magnetic plate 71 can be delayed. The magnetic plate 71 is formed stepwise to adjust the heat value of the magnetic plate 71 and prevent the fixing belt 50 in the non-paper passing region from being excessively heated by the heat generation of the magnetic plate 71. The cutout section 71*d* is formed in the center region of the magnetic plate 71 to prevent the heat generation of the magnetic plate 71 from affecting a detection result of the center thermistor 61.

According to the first embodiment, the one-wing slits 57*a* are arranged in zigzag in the center region in the longitudinal direction of the IH coil unit 52 to attain a reduction in the weight of the IH coil unit 52. The both-wing slits 58*a* are arranged on both the sides of the one-wing slits 57*a* to increase concentration of a magnetic flux on both the sides of the IH coil unit 52. A drop of the temperature of the fixing belt 50 is prevented in the region corresponding to the end portion of the IH coil unit 52 to keep a desired fixing temperature. Occurrence of a fixing failure caused by the drop of the temperature of the fixing belt 50 is prevented at the end portion of the fixing device 34.

The edge thermistor 62 is arranged in the position corresponding to the region between the end portion 58*b* of the second core 58 and the end portion 70*a* of the magnetic shunt alloy layer 70 to highly accurately detect the temperature of the edge region of the fixing belt 50.

Second Embodiment

Figure 9:
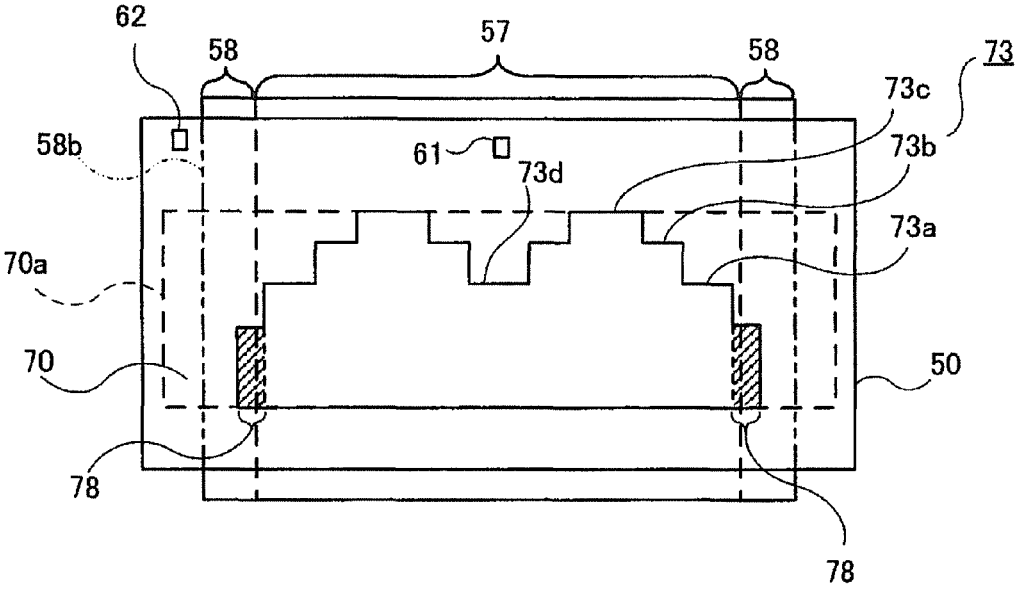
FIG. 9 is a schematic explanatory diagram showing the arrangement of a magnetic plate, a magnetic shunt alloy layer, a fixing belt, and an IH coil unit viewed from the magnetic plate side in a second embodiment.

A fixing device in a second embodiment is explained with reference to FIGS. 9 and 10. In the second embodiment, an auxiliary heat generating section is further arranged on the magnetic plate in the first embodiment. In the second embodiment, components same as the components explained in the first embodiment are denoted by the same reference numerals and signs and detailed explanation of the components is omitted.

A magnetic plate 73 in the second embodiment is formed in an arcuate shape along the inner circumferential surface of the magnetic shunt alloy layer 70 with the gap G2 apart from the inner circumferential surface of the magnetic shunt alloy layer 70. A temperature rise ratio of the magnetic plate 73 by electromagnetic induction is set larger than a temperature rise ratio of the magnetic shunt alloy layer 70. As shown in FIG. 9, the magnetic plate 73 includes a plurality of widths stepwise in the longitudinal direction of the fixing belt 50. For example, a first stage 73*a* of the magnetic plate 73 is formed in width for covering the A4R size and the letter size of the JIS standard. A second stage 73*b* of the magnetic plate 73 is formed in width for covering the B5R size of the JIS standard. A third stage 73*c* of the magnetic plate 73 is formed in width for covering the A5R size of the JIS standard.

The width of magnetic plate 73 is formed in a plurality of steps to adjust a heat value of the magnetic plate 73 in the longitudinal direction of the fixing belt 50. If the sheets P having a small size are continuously subjected to fixing, the heat value of the magnetic plate 73 in a non-paper passing region is reduced to prevent the fixing belt 50 from excessively generating heat in the non-paper passing region. A cutout section 73*d* is provided in a center region, which is a position corresponding to the center thermistor 61.

On the magnetic plate 73, edge sections 78, which are auxiliary heat generating sections, are arranged on both sides of the first stage 73*a*. The edge sections 78 are opposed to the IH coil unit 52 in a region extending across the first core 57 and the second cores 58 in the longitudinal direction of the IH coil unit 52. The heat value of the heat generating layer 50*a* of the fixing belt 50 decreases in positions corresponding to boundary regions between the first core 57 and the second cores 58. The edge sections 78 generate heat in regions extending across the boundary regions between the first core 57 and the second cores 58.

The edge sections 78 have a function of assisting heating of the fixing belt 50 corresponding to the boundary regions between the first core 57 and the second cores 58 and a function of promoting a temperature rise of the magnetic shunt alloy layer 70.

Figure 10:
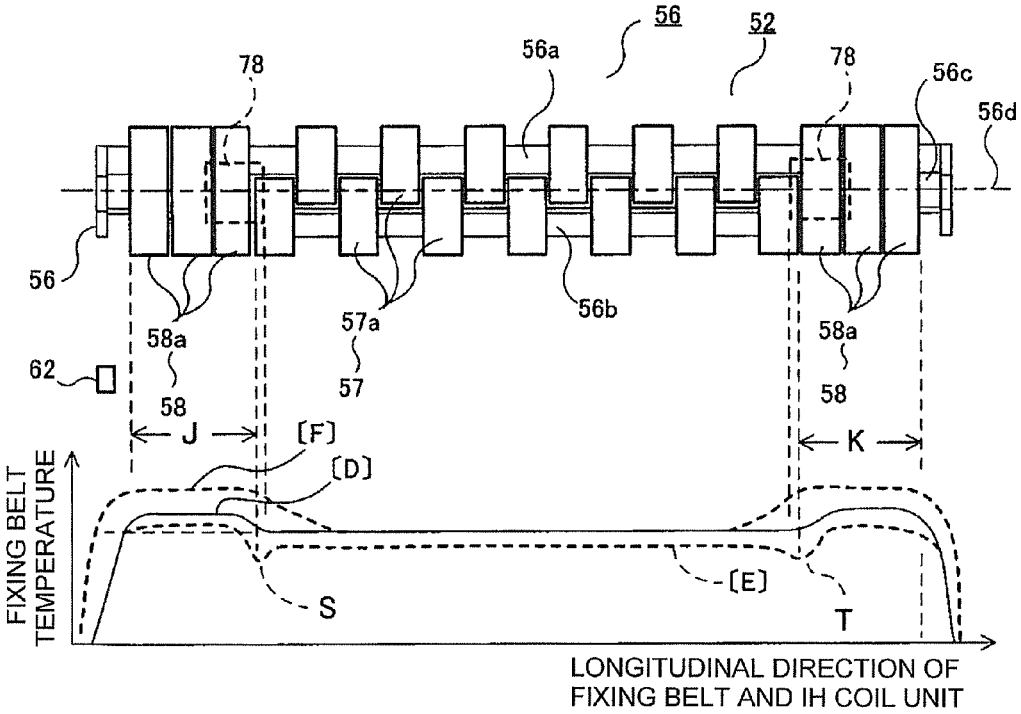
FIG. 10 is a schematic explanatory diagram showing a relation between the IH coil unit and an edge section of the magnetic plate and the temperature of the fixing belt in the second embodiment.

In a comparative example 2, For example, if the temperature of the fixing belt 50 in the longitudinal direction is measured using the fixing belt 50, on the inner circumference of which a magnetic plate without an edge section is arranged, a result indicated by a broken line E in FIG. 10 is obtained. If the magnetic plate not including the edge section is used, in the fixing belt 50, a temperature drop occurs in boundary positions S and T between the first core 57 and the second cores 58. In the fixing device in the comparative example 2, it is likely that a fixing failure in the boundary positions S and T occurs because of the temperature drop in the boundary positions S and T.

In the fixing belt 50 in which the magnetic plate 73 including the edge sections 78 is arranged in the second embodiment, if the temperature of the fixing belt 50 in the longitudinal direction is measured, a result indicated by a solid line D in FIG. 10 is obtained. Because of the heat generation of the edge sections 78, in the fixing belt 50, a temperature drop does not occur even in the boundary positions S and T between the first core 57 and the second cores 58. The fixing belt 50 obtains a desired fixing temperature over the entire length in the longitudinal direction of the fixing belt 50. The fixing device 34 obtains satisfactory fixing over the entire length in the longitudinal direction of the fixing belt 50 without causing a fixing failure in the boundary positions 0 and T between the first core 57 and the second cores 58.

Further, the edge sections 78 promote a temperature rise of the magnetic shunt alloy layer 70 and prevent an excessive temperature rise of the fixing belt 50 in a detection region of the edge thermistor 62. A temperature rise ratio of the fixing belt 50 in the regions J and K opposed to the second cores 58 having both-wings is larger than a temperature rise ratio of the fixing belt 50 in a region opposed to the first core 57 having one-wings. For example, if the temperature of the fixing belt 50 in the regions J and K opposed to the second cores 58 suddenly rises and, on the other hand, the magnetic shunt alloy layer 70 delays in reaching the Curie temperature, the magnetic shunt alloy layer 70 cannot attain a temperature rise prevention for the fixing belt 50.

In the regions J and K opposed to the second cores 58, it is likely that the temperature of the fixing belt 50 excessively rises before the magnetic shunt alloy layer 70 reaches the Curie temperature. If the edge thermistor 62 present in the region J or K opposed to the second core 58 of the fixing belt 50 detects the excessive rise in the temperature of the fixing belt 50, the MFP 10 suspends the inverter driving circuit 68 and changes to a wait state. Therefore, if the edge sections 78 are absent, the MFP 10 tends to wait because of the excessive temperature rise of the fixing belt 50 in the regions J and K opposed to the second cores 58.

On the other hand, the temperature of the edge sections having the temperature rise ratio larger than the temperature rise ratio of the magnetic shunt alloy layer 70 rises more quickly than the magnetic shunt alloy layer 70 in the regions J and K opposed to the second cores 58. The edge sections 78 promote the heating of the magnetic shunt alloy layer 70. The temperature rise of the magnetic shunt alloy layer 70 is accelerated by the heating from the edge sections 78. The magnetic shunt alloy layer 70 reaches the Curie temperature fast. Since the magnetic shunt alloy layer 70 reaches the Curie temperature fast, the temperature of the fixing belt 50 in the regions J and K opposed to the second cores 58 is suppressed from excessively rising. The MFP 10 is prevented from changing to the wait state.

The size of the edge sections 78 in the longitudinal direction of the fixing belt 50 is not limited. As the width of the edge sections 78 in the longitudinal direction of the fixing belt 50 increases, the temperature of the fixing belt 50 in the regions J and K opposed to the second cores 58 is raised, for example, as indicated by a broken line F in FIG. 10. If the temperature of the fixing belt 50 is raised in the regions J and K opposed to the second cores 58, it is likely that the edge thermistor 62 detects the temperature rise of the fixing belt 50 and changes the MFP 10 to the wait state.

If the end portions of the edge sections 78 are formed in a size about a half of the second cores 58 in the longitudinal direction of the fixing belt 50, the raise of the temperature of the fixing belt 50 due to the edge sections 78 is suppressed. Therefore, to suppress the MFP 10 from waiting because of the raise of the temperature of the fixing belt 50, it is preferable to set the size of the edge sections 78 to about a half of the second cores 58. The edge sections 78 may be provided separately from the magnetic plate 73 rather than being integrated with the magnetic plate 73.

According to the second embodiment, as in the first embodiment, even if the magnetic shunt alloy layer 70 stops the heat generation, the magnetic plate 73 generates heat and assists the heating of the fixing belt 50. If the magnetic shunt alloy layer 70 stops the heat generation, an excessively large load is prevented from being applied to the IGBT element 68*a* and the like. Breakage of the inverter driving circuit 68 is prevented to obtain satisfactory fixing performance.

According to the second embodiment, as in the first embodiment, the heating of the magnetic shunt alloy layer 70 by the magnetic plate 73 is delayed by the gap G2. The magnetic plate 73 is formed stepwise to prevent the non-paper passing region of the fixing belt 50 from excessively generating heat. The cutout section 73*d* is formed in the center region of the magnetic plate 73 to improve temperature detection accuracy of the fixing belt 50 by the center thermistor 61.

According to the second embodiment, as in the first embodiment, a reduction in the weight of the IH coil unit 52 is attained by the first core 57. The second cores 58 are arranged on both the sides of the first core 57 to keep the fixing belt 50 at the fixing temperature in the region corresponding to the end portion of the IH coil unit 52. Occurrence of a fixing failure at the end portion of the fixing device 34 is prevented. The edge thermistor 62 is arranged in the position corresponding to the region between the end portion 58*b* of the second core 58 and the end portion 70*a* of the magnetic shunt alloy layer 70 to improve temperature detection accuracy of the edge region of the fixing belt 50.

According to the second embodiment, the edge sections 78 are provided in the regions opposed to the IH coil unit 52 via the fixing belt 50 and extending across the first core 57 and the second cores 58. The heating of the fixing belt 50 is assisted in the regions extending across the boundary regions between the first core 57 and the second cores 58. A temperature drop of the fixing belt 50 in the boundary regions between the first core 57 and the second cores 58 is prevented. A desired fixing temperature is maintained over the entire length in the longitudinal direction of the fixing belt 50. The fixing device 34 obtains satisfactory fixing over the entire length in the longitudinal direction of the fixing belt 50.

According to the second embodiment, the magnetic shunt alloy layer 70 is heated by the edge sections 78 to promote speed of the magnetic shunt alloy layer 70 reaching the Curie temperature. A temperature rise of the fixing belt 50, the temperature rise ratio of which increases in the regions J and K opposed to the second cores 58 having a large magnetic flux concentration force, is prevented to prevent the MFP 10 from changing to the weight state and improve print production efficiency.

According to at least one of the embodiments explained above, even if the temperature-sensitive magnetic body stops the heat generation, the magnetic plate generates heat to assist the heating of the heat generating section. If the heat generation of the temperature-sensitive magnetic body is stopped, an excessively large load is prevented from being applied to the IH driving circuit to prevent the driving circuit from being broken. Further, the fixing belt is formed in a concave-convex shape to prevent excessive heat generation of the non-paper passing region or improve temperature detection accuracy of the fixing belt. The magnetic bodies of the one-wing first magnetic-flux regulating section are axially symmetrically alternately arranged to attain a reduction in the weight of the induction-current generating section. Further, the both-wing second magnetic-flux regulating sections are arranged on both the sides of the first magnetic-flux regulating sections to prevent a fixing failure at the end portion of the fixing device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device comprising:

an endless heat generating section including a conductive layer;

a magnetic-flux generating section configured to generate a magnetic flux and generate an induction current in the conduction layer;

a first magnetic-flux regulating section having a first magnetic flux concentration force and configured to regulate the magnetic flux of the magnetic-flux generating section, wherein the first magnetic-flux regulating section is a one-wing regulating section in which a plurality of one-wing slits are alternately arranged with axial symmetry to a center line in a longitudinal direction of the magnetic-flux generating section, the one-wing regulating section alternating regulating the magnetic flux of the magnetic-flux generating section for each of one-wings;

a second magnetic-flux regulating section arranged adjacent to the first magnetic-flux regulating section, having a second magnetic flux concentration force larger than the first magnetic flux concentration force, and configured to regulate the magnetic flux of the magnetic-flux generating section, wherein the second magnetic-flux regulating section is a both-wing regulating section in which both-wing slits are arranged, the both-wing regulating section regulating a magnetic flux of both-wings of the magnetic-flux generating section; and an auxiliary heat generating section including a magnetic body arranged in a position opposed to the magnetic-flux generating section via the endless heat generating section, the position being a region extending across the first magnetic-flux regulating section and the second magnetic-flux regulating section.

2. The device according to claim 1, further comprising:

a temperature-sensitive magnetic body present between the endless heat generating section and the auxiliary heat generating section and having a width projecting further than the second magnetic-flux regulating section; and a magnetic plate present in a position opposed to the endless heat generating section via the temperature-sensitive magnetic body and having a width equal to a width of the first magnetic-flux regulating section.

3. The device according to claim 1, wherein the auxiliary heat generating section extends to a center portion of the second magnetic-flux regulating section.

4. An image forming apparatus comprising:

an image forming section configured to form an image on a recording medium; and the fixing device according to claim 1 configured to fix the image on the recording medium.

* * * * *